US005890395A

United States Patent [19]

Kawata et al.

[11] Patent Number: 5,890,395

[45] Date of Patent: Apr. 6, 1999

[54] SUBSTRATE FOR AN ELECTROPHOTOGRAPHIC PHOTOCONDUCTOR

[75] Inventors: Noriaki Kawata, Nagano; Kiyoshi Hikima, Saitama, both of Japan

[73] Assignee: Fuji Electric Co., Ltd., Tokyo, Japan

[21] Appl. No.: 3,239

[22] Filed: Jan. 6, 1998

Related U.S. Application Data

[62] Division of Ser. No. 623,255, Mar. 28, 1996.

[30] Foreign Application Priority Data

Mar. 31, 1995 [JP] Japan ..... PA 7-074990
Nov. 17, 1995 [JP] Japan ..... PA 7-299401

[51] Int. Cl.[6] ..... G03G 15/00

[52] U.S. Cl. ..... 74/431; 74/434; 74/DIG. 10; 399/159; 399/167

[58] Field of Search ..... 74/431, 432, 434, 74/DIG. 10; 399/169, 167; 430/58, 62, 63

[56] References Cited

U.S. PATENT DOCUMENTS 5,371,576 12/1994 Gonda ..... 399/167 X
5,649,267 7/1997 Aerens et al. ..... 399/159
5,652,077 7/1997 Obinata ..... 399/167 X
5,669,045 9/1997 Swain ..... 399/159
5,740,501 4/1998 Tonomoto et al. ..... 399/159 X
5,752,136 5/1998 Sanchez et al. ..... 399/167 X
5,774,767 6/1998 Shibata et al. ..... 399/167

*Primary Examiner*—Khoi Q. Ta
*Attorney, Agent, or Firm*—Baker & Botts, L.L.P.

[57] ABSTRACT

A cylindrical tubular substrate for an electrophotographic photoconductor is made of a conductive resin. The substrate is smoothly rotatable about its axis of rotation, securely grounded, and easily and inexpensively manufactured. It has a cylindrical tube portion and a flange portion with a gear and a shaft through-hole. These portions can be integrated as a unit of a material containing an electrically conductive resin as the main component. Alternatively, the shaft is integrated unitarily with the substrate by single-step molding. Or further, a flange, made of a resin with high sliding wear resistance and with a gear and a shaft through-hole, or a previously molded flange made of a resin with high sliding wear resistance and with a gear and a shaft insert-molded to the flange, with an electric conductor, is disposed in an assembling molding step at an end of a cylindrical tube made essentially of a conductive resin.

8 Claims, 4 Drawing Sheets

SUBSTRATE FOR AN ELECTROPHOTOGRAPHIC PHOTOCONDUCTOR

This is a divisional of copending application Ser. No. 0/08/623,255 filed on Mar. 28, 1996.

FIELD OF THE INVENTION

The present invention relates to a substrate for an electrophotographic photoconductor, and more specifically to a cylindrical tubular substrate made mainly of an electrically conductive resin and provided with means, installed at an end of the cylindrical tubular substrate, for transmitting rotational driving force to the substrate and for grounding the substrate.

BACKGROUND OF THE INVENTION

An electrophotographic apparatus (hereinafter referred to as a "primary apparatus"), e.g., a copying machine or a printer using electrophotographic techniques, comprises a photoconductor having an electrically conductive substrate and a photoconductive layer disposed on the conductive substrate. Typically, the photoconductor is mounted on the primary apparatus by a shaft which is rotatable about the axis of rotation of the cylindrical tubular substrate. As the cylindrical tubular substrate rotates continuously about its axis of rotation, an image is formed by charging up the photoconductor surface, exposing the charged photoconductor surface to form a latent image, developing the latent image with a developing agent containing toner, and copying and fixing the toner image on a supporting means such as paper or the like. After the toner image has been copied, the photoconductor surface is cleaned and discharged so that the photoconductor may be used repeatedly.

For mounting the photoconductor rotatably about its axis of rotation on the primary apparatus, and for rotating the mounted photoconductor, a flange for transmitting the rotational driving force (hereinafter referred to as a "driving flange") is inserted and affixed to an end of the cylindrical tubular substrate. The driving flange has a through-hole into which a metallic shaft is inserted coaxially with the cylindrical tubular substrate, and a gear for transmitting the rotational driving force from the primary apparatus to the substrate. Another flange for fixing the axis of rotation (hereinafter referred to as a "fixing flange") is inserted and affixed to the other end of the cylindrical tubular substrate. The fixing flange has a through-hole into which the metallic shaft is inserted. The driving flange also serves as an electrode for grounding the photoconductor. Recently, resin flanges have been used due to their light weight. Typically, the photoconductor is grounded, at the time the resin flange is installed on the photoconductor, by installing a metallic spring which electrically interconnects the substrate and the shaft.

For high-quality copying or printing, it is necessary to rotate the photoconductor very precisely about its axis of rotation, without wobble or eccentricity. It is important for the photoconductor not to yield under pressure during the copying or cleaning process. Thus, the driving flange should be installed tightly on the substrate, and highly coaxial with its axis of rotation. Also, the gear of the driving flange is required to have sufficient fatigue resistance, wear resistance and mechanical strength.

On account of their excellent machinability, excellent surface properties, low cost and light weight, aluminum alloys have been widely used as the material of the cylindrical tubular substrate. However, to meet the dimensional and surface-roughness specifications, it is necessary to machine the peripheral surface of each cylindrical aluminum alloy substrate with high precision. It is necessary also to insert a flange for rotating the substrate with high precision in the layer-by-layer formation of a photoconductor. It is necessary further to clean contaminants from the outer substrate surface before forming the photoconductive layer. Since an aluminum alloy surface may undergo change depending on the storage environment, it is also necessary to take countermeasures, e.g., by covering the substrate surface with an oxide film. As a result, conventional aluminum alloy substrates have been made using many manufacturing steps at high cost.

Japanese Patent Document No. H02-17026 discloses a cylindrical tubular substrate that is lighter in weight, highly resistant chemically and thermally, neither oxidized nor deformed in air, and compatible with photoconductors. This substrate can be made by injection molding of a polyphenylene sulfide resin (hereinafter referred to as "PPS resin") to which carbon black is added for electric conductivity.

For such a cylindrical tubular substrate made of a conductive resin, a resin driving flange is preferred. The resin flange may be installed on the resin substrate by pressing the flange into an adhesive-coated insertion portion of the resin substrate. But it is difficult to fix the driving flange at an end of a cylindrical tubular substrate coaxially with the rotation axis of the substrate.

As described above, it is necessary to ground the cylindrical tubular substrate so that the substrate may function as one of the electrodes of the photoconductor. Typically, the cylindrical tubular substrate is grounded by installing a metallic spring at the time the resin driving flange is inserted and fixed to the substrate, so that the substrate and the shaft are electrically interconnected. This requires additional processing steps. Also, the cost of the photoconductor is increased, as conductive adhesive should be applied between the resin substrate and the non-conductive driving flange because of high contact resistance between the substrate and the flange.

SUMMARY OF THE INVENTION

It is an object of the invention to provide an easily and inexpensively manufactured cylindrical tubular substrate which is made mainly of an electrically conductive resin, with a means for transmitting the rotational driving force highly coaxially from the primary apparatus and for rotating the substrate with high precision about its axis of rotation, and with a means for effectively grounding the substrate.

According to an aspect of the invention, there is provided a substrate for an electrophotographic photoconductor, comprising a cylindrical tube, a metallic shaft and a driving flange for rotating the substrate, the driving flange having a through-hole for supporting the shaft coaxially with the cylindrical tube and a gear for transmitting rotational driving force, the cylindrical tube and the driving flange being made mainly of an electrically conductive resin and being molded as a unit, in which the driving flange is coaxially disposed at an end of the cylindrical tube forming the substrate.

A gear may be unitarily formed on the outer peripheral surface of the driving flange, or on the inner peripheral surface of the driving flange.

According to another aspect of the invention, there is provided a substrate for an electrophotographic photoconductor, comprising a cylindrical tube, a metallic shaft and a driving flange for rotating the substrate, the driving flange having a gear for transmitting rotational driving force, the cylindrical tube and the driving flange being made mainly of an electrically conductive resin, the cylindrical tube, the driving flange and the metallic shaft being molded as a unit, in which the driving flange is coaxially disposed at an end of the cylindrical tube end and the metallic shaft is inserted into the driving flange coaxially with the cylindrical tube to form the substrate.

Advantageously, at least one recess or protrusion is formed in the contact area of the metallic shaft with the driving flange.

According to still another aspect of the invention, there is provided a substrate for an electrophotographic photoconductor, comprising a cylindrical tube made mainly of an electrically conductive resin, a metallic shaft, a driving flange formed in a first molding step from a low-sliding-friction material and having a gear for transmitting rotational driving force and a through-hole for supporting the shaft coaxially with the cylindrical tube, and an electric conductor for electrically interconnecting the cylindrical tube and the shaft, the cylindrical tube, the driving flange and the electric conductor being integrated as a unit in a second molding step for molding the cylindrical tube, such that the driving flange is coaxially disposed at an end of the cylindrical substrate tube.

Advantageously, at least one recess or protrusion is formed in the contact area of the driving flange with the cylindrical tube.

According to still another aspect of the invention, there is provided a substrate for an electrophotographic photoconductor, comprising a cylindrical tube made mainly of an electrically conductive resin, a metallic shaft, a driving flange formed in a first molding step from a low-sliding-friction material and having a gear for transmitting rotational driving force, the metallic shaft being inserted into the driving flange in the first molding step, and an electric conductor for electrically interconnecting the cylindrical tube and the shaft, the cylindrical tube, the driving flange and the electric conductor being integrated as a unit in a second molding step for molding the cylindrical tube, such that the driving flange is coaxially disposed at an end of the cylindrical tube and the metallic shaft is coaxial with the cylindrical tube in the substrate.

Advantageously, at least one recess or protrusion is formed respectively in the contact area of the metallic shaft with the driving flange and in the contact area of the driving flange with the cylindrical tube.

Advantageously further, the material having low sliding friction has a coefficient of friction of 0.3 or less.

Advantageously, the electrically conductive resin comprises polyphenylene sulfide and carbon black, or polyphthalamide and carbon black.

DETAILED DESCRIPTION OF PREFERRED EMBODIMENTS

Figure 1A:
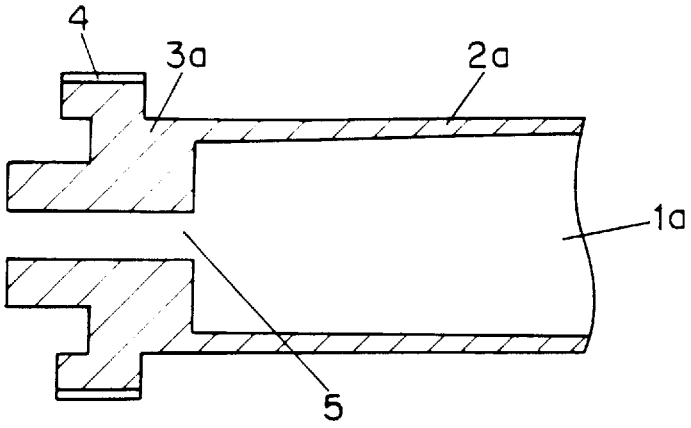
FIG. 1A is a schematic cross section of a main part of a first embodiment of a substrate according to the invention.

In the figures, reference numerals refer to elements as follows: 1*a*, 1*b*, 1*c*, 1*d*—substrate; 2*a*, 2*b*—cylindrical tube portion; 2*c*, 2*d*—cylindrical tube; 3*a*, 3*b*—flange portion or driving flange portion; 3*c*, 3*d*— flange or driving flange; 4, 4*a*—gear; 5—shaft through-hole; 6—shaft; 7—annular protrusion; 8—electric conductor; 9—core die; 10—cavity die; 11—fixing die; 12—flange die; 13—gear die portion; 14—through-hole die portion; 15, 16—shaft insertion portion; 17—gear molding portion; 18—shaft hole molding portion; 19—conductor setting portion; 20—annular protrusion molding portion; 21—shaft insertion portion.

The substrate is formed as a unitary molding, using a material containing an electrically conductive resin as the main component, a cylindrical tube and a driving flange for rotating the substrate, which driving flange has a through-hole for supporting a metallic shaft coaxially with the cylindrical tube and a gear for transmitting rotational driving force, so that the driving flange is coaxially disposed at an end of the cylindrical tube to form the substrate. Thus, the substrate can be manufactured more easily than before, when the substrate was manufactured by individually molding the cylindrical tube and the driving flange and by bonding the driving flange with an adhesive to an end of the cylindrical tube. Moreover, the axis of rotation of the cylindrical tube and the central axis of the shaft through-hole of the flange can be aligned coaxially by the molding die. With the cylindrical tube and the driving flange made of the same electrically conductive resin, the cylindrical tube can be grounded easily via the metallic shaft. Furthermore, substrates with multiple types of flanges having various shapes and dimensions may be made easily by employing an insert die structure for the flange die and by changing the shape and dimensions of the flange die corresponding to the type of substrate to be manufactured next.

By unitarily molding the cylindrical tube and driving flange together with the shaft, the cylindrical tube, driving flange and shaft are aligned highly coaxially with one another by the molding die. With rotational sliding now between the shaft and the primary apparatus (rather than between the substrate and the shaft as before), the sliding performance of the rotating substrate is improved. For this, it is important to form at least one recess or protrusion in the contact area of the shaft with the flange. Then, even if the resin of which the flange is made is not particularly adhesive to the metallic shaft, the shaft is prevented from separating from the flange or from eccentric rotation.

By integrating a cylindrical tube, a driving flange molded in a first molding step using a material having low sliding friction and having a shaft through-hole for supporting a metallic shaft and a gear for transmitting the rotational driving force from the primary apparatus, and an electric conductor for electrically interconnecting the cylindrical tube and shaft as a unit by a second molding step using an electrically conductive resin as the main component of the cylindrical tube, wear of the gear and the sliding portion of the shaft is greatly reduced. The first and second molding steps are performed readily in a molding die. Such two-step molding eliminates the need for inserting the flange in the cylindrical tube and bonding them with an adhesive, and facilitates aligning the flange and the cylindrical tube highly coaxially with one another. The cylindrical tube and the shaft can be electrically interconnected easily by molding the cylindrical tube, shaft and electric conductor as a unit. In this structure, it is important to form at least one recess or protrusion in the contact area of the outer periphery of the flange with the cylindrical tube. Then, even if the resin of which the flange is made is not particularly adhesive to the resin of the cylindrical tube, the flange is prevented from displacing during molding, from separating from the cylindrical tube, or from eccentric rotation. By integrating the flange and the shaft as a unit by insert-molding, using a first molding step and a second molding step for assembly, coaxial alignment of the shaft with the cylindrical tube is improved further. In this structure, as in the foregoing simultaneous single-step molding of the cylindrical tube, flange and shaft, it is important to form at least one recess or protrusion in the contact area of the shaft with the flange. This recess or protrusion prevents the shaft from separating from the flange and prevents eccentric rotation.

For an integrated unit including the driving flange and the cylindrical tube, polyphthalamide has advantages over polyphenylene sulfide with respect to fatigue resistance and wear resistance.

First Embodiment

Figure 1B:
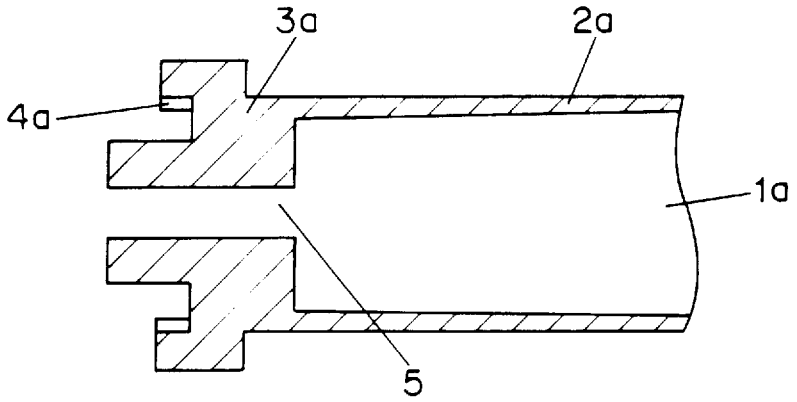
FIG. 1B is a schematic cross section, similiar to that in FIG. 1A, showing an inner peripheral gear.

In FIG. 1A, a substrate 1*a* (hereinafter sometimes referred to as the "first substrate") has a cylindrical tube portion 2*a* and a driving flange portion 3*a* for rotational driving. The cylindrical tube portion 2*a* and the driving flange portion 3*a* are made mainly of the same electrically conductive resin and are unitarily formed as the first substrate 1*a*. A gear 4 is installed in the driving flange portion 3*a*, and a through-hole 5, for insertion of a metallic shaft, is formed through the driving flange portion 3*a*. Alternatively, as shown in FIG. 1B, a gear 4*a* can be installed on an inner peripheral surface of the driving flange portion 3*a*.

Figure 5:
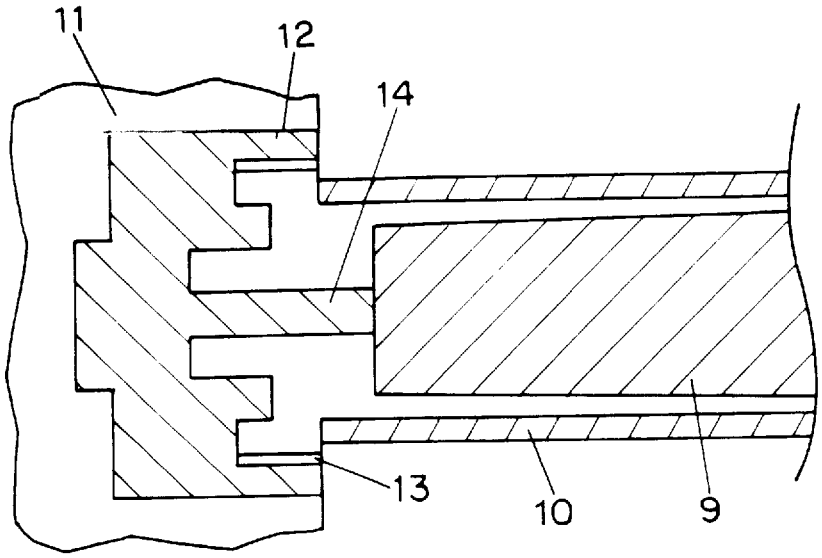
FIG. 5 is a cross section of a molding die for molding the substrate of FIG. 1A.

The first substrate 1*a*, of FIG. 1A, can be formed with a molding die as shown in FIG. 5, comprising a core die 9, a cavity die 10, and a fixed die 11 having an injection gate (not shown). A flange die 12 is mounted on the fixed die 11. A gear die portion 13 and a shaft through-hole die portion 14 are formed on the flange die 12. The core die 9 is finished to have 1 μm or less in maximum height Rmax as an index of surface roughness. The peripheral surface of the core die 9 slants with respect to its axis of rotation by from 0.15 to 0.26 degrees of angle for ease of pulling out the molded substrate. The inner surface of the cavity die 10 has no slant. The surface of the cavity die 10 is finished to have a maximum height Rmax of 1 μm or less.

A first substrate 1*a*, of FIG. 1A, was fabricated by unitarily forming a cylindrical tube portion 2*a* and a flange portion 3*a*. The molding die, shown in FIG. 5, was heated at between 120° and 150° C. An electrically conductive PPS resin to which 10 to 25 weight % of carbon black had been added was heated at between 280° and 330° C. The heated conductive resin was loaded into the heated molding die by the side gate method. Another first substrate was fabricated in similar manner by heating the molding die at between 130° and 160° C., and an electrically conductive PPA resin (polyphthalamide resin) to which 10 to 25 weight % of carbon black had been added, at between 280° and 330° C.

Such first substrates can be grounded easily and securely through a shaft inserted into the through-hole 5.

Second Embodiment

Figure 2:
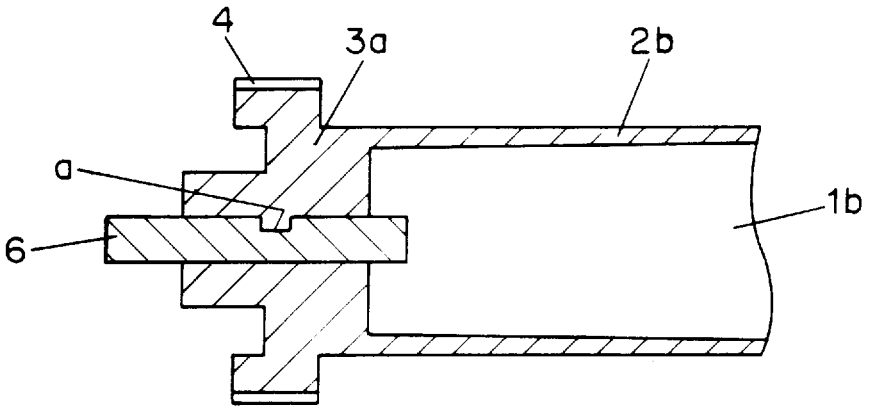
FIG. 2 is a schematic cross section of a main part of a second embodiment of a substrate according to the invention.

In FIG. 2, a substrate 1*b* (hereinafter sometimes referred to as the "second substrate") has a cylindrical tube portion 2*b*, a driving flange portion 3*b* for rotational driving, and a metallic shaft 6 inserted into the driving flange portion 3*b*. The cylindrical tube portion 2*b* and driving flange portion 3*b* are made of the same electrically conductive resin and are unitarily formed with the metallic shaft 6 to be the second substrate 1*b*. A protrusion, formed on the inner surface of the driving flange portion 3*b*, and a recess "a", formed on the shaft 6, are mutually coupled so as to prevent the shaft 6 from separating and to prevent eccentric rotation.

Figure 6:
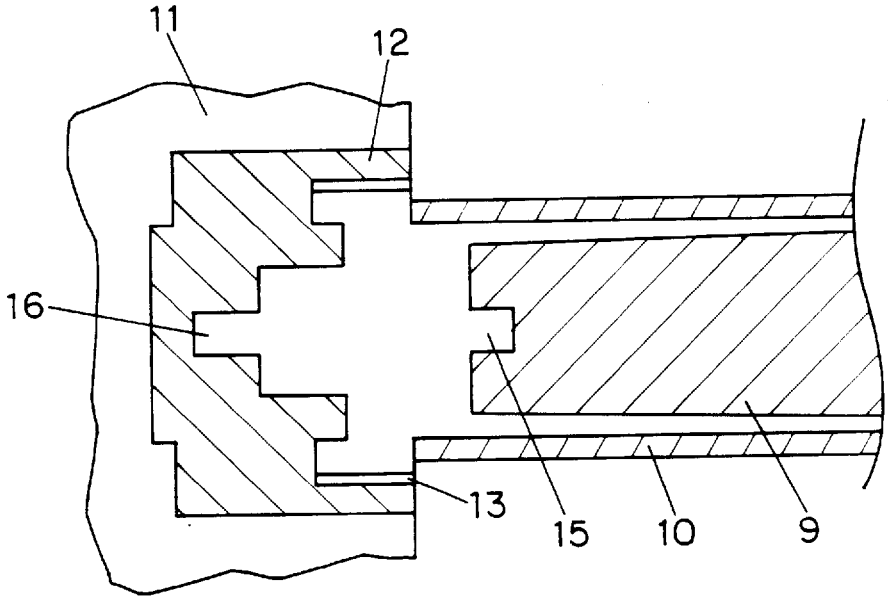
FIG. 6 is a cross section of a molding die for molding the substrate of FIG. 2.

The second substrate 1*b*, of FIG. 2, can be formed with a molding die shown in FIG. 6. Shown are a core die 9, a cavity die 10, and a fixed die 11 having an injection gate (not shown). A flange die 12 is mounted on the fixed die 11. A gear die portion 13 is formed on the flange die 12. Shaft insertion portions 15 and 16 are formed, respectively, on the top end center of the core die 9 and in the central part of the flange die 12. The surface of the core die 9 is finished to have a maximum height Rmax of 1 μm or less. The peripheral surface of the core die 9 slants with respect to its axis of rotation by from 0.15 to 0.26 degrees of angle for ease of pulling out the molded substrate. The inner surface of the cavity die 10 has no slant. The surface of the cavity die 10 is finished to have a maximum height Rmax of 1 μm or less.

A second substrate 1*b*, of FIG. 2, was fabricated in the same manner as the first substrate with the molding die of FIG. 6, with a shaft 6 set in the shaft insertion portions 15 and 16 of the molding die. The recess "a", formed on the part and contacting the driving flange portion 3*b* of the periphery of the shaft 6, is filled with resin during unitary molding, so that separation or eccentric rotation of the shaft 6 is prevented.

This second substrate can be grounded easily and securely through the shaft 6.

Third Embodiment

Figure 3A:
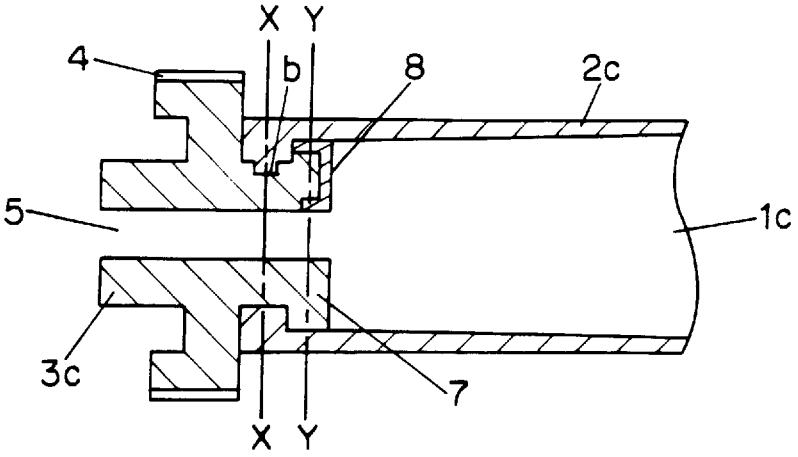
FIG. 3A is a schematic longitudinal cross section of a main part of a third embodiment of a substrate according to the invention.

In FIG. 3A, a substrate 1*c* (hereinafter sometimes referred to as the "third substrate") has a cylindrical tube 2*c*, made mainly of an electrically conductive resin, a driving flange 3*c* for rotational driving and made of a material having low sliding friction, formed independently from cylindrical tube 2*c*, and having a gear 4, and an electric conductor 8 for electrically interconnecting the cylindrical tube 2*c* and a shaft. The substrate 1*c* is made by unitarily integrating the molded driving flange 3*c* (molded in a first molding step) and the conductor 8 with an end of the cylindrical tube 2*c* in a subsequent second molding step. Thus, the third substrate is made by two-step molding.

Figure 3B:
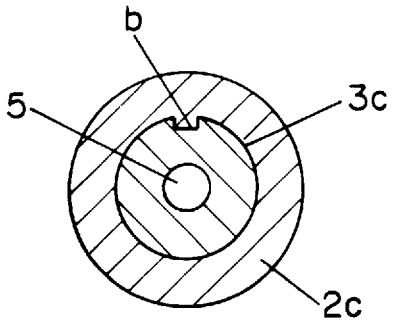
FIG. 3B is a cross section at X—X of FIG. 3A.

In FIGS. 3A and 3B, the symbol "b" designates a recess for preventing eccentric rotation of the driving flange 3*c*.

In FIG. 3A, reference numeral 7 designates an annular protrusion formed on the outer periphery of the driving flange 3*c* for preventing the flange 3*c* from separating from the cylindrical tube 2*c*.

Figure 7:
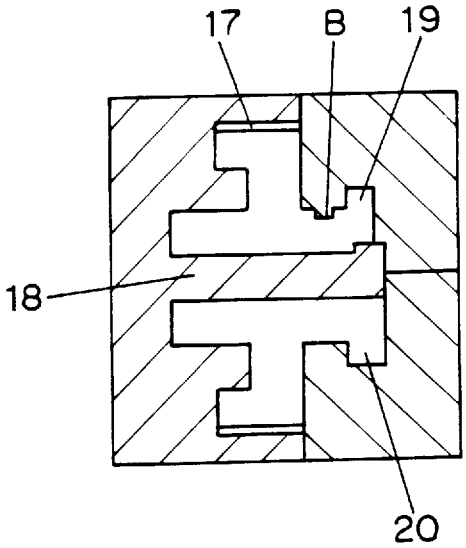
FIG. 7 is a cross section of a molding die for molding the driving flange of FIG. 3A.

For molding the driving flange 3*c* of FIG. 3A, the molding die of FIG. 7 has a gear molding portion 17, a shaft hole molding portion 18, a conductor setting portion 19, and an annular protrusion molding portion 20. The molding die also has a protrusion "B" for forming the recess "b" on the flange 3*c*.

Figure 3C:
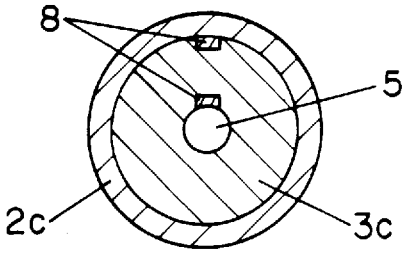
FIG. 3C is a cross section at Y—Y of FIG. 3A.
Figure 8:
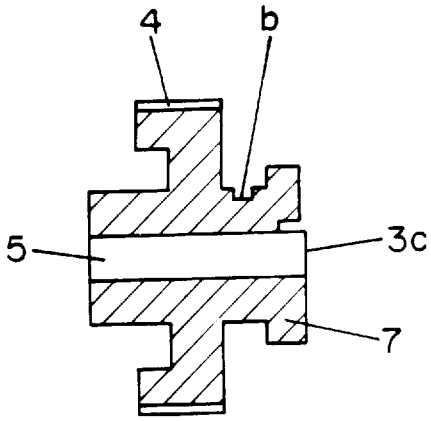
FIG. 8 is a cross section of the driving flange molded with the molding die of FIG. 7.

The flange 3*c*, whose cross section is shown in FIG. 8, is formed by loading and curing, in the molding die of FIG. 7, a mixture of a material having low sliding friction, e.g., a polyamide resin and carbon fiber. The third substrate 1*c*, of FIG. 3, then is obtained by molding in a second molding step the cylindrical tube 2*c*, using a similar material as in the first embodiment, by which the unit including the flange 3*c* and conductor 8 is further integrated unitarily with the cylindrical tube 2*c* so that the flange 3*c* is disposed at an end of the cylindrical tube 2*c*.

The resulting third substrate can be grounded easily and securely through the conductor 8 and the shaft 6. The annular protrusion 7 prevents the flange from separating from the cylindrical tube, and the recess "b" prevents the flange and the cylindrical tube from eccentric rotation.

Fourth Embodiment

Figure 4:
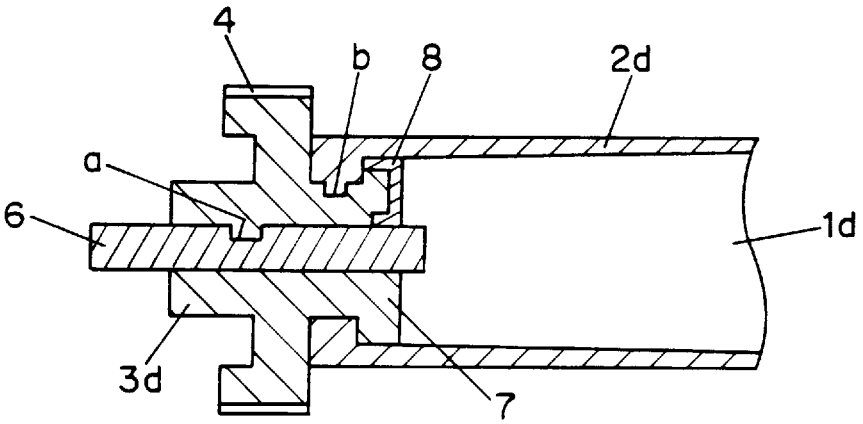
FIG. 4 is a schematic longitudinal cross section of a main part of a fourth embodiment of a substrate according to the invention.

In FIG. 4, a substrate 1*d* (hereinafter sometimes referred to as the "fourth substrate") has a cylindrical tube 2*d*, made mainly of an electrically conductive resin, a driving flange 3*d* for rotational driving, made of a material having low sliding friction, formed unitarily with a metallic shaft 6, molded first to the molding of the cylindrical tube 2*d* and having a gear 4, and an electric conductor 8 for electrically interconnecting the cylindrical tube 2*d* and the shaft 6. The substrate 1*d* is made by further unitary integration of the driving flange 3*d* and the conductor 8 (which were integrated as a unit by a first molding step) with an end of the cylindrical tube 2*d* in a second molding step. Thus, the fourth substrate is made by two-step molding. In FIG. 4, the symbol "a" designates a recess formed on the shaft 6 to prevent the shaft 6 from separating and to prevent eccentric rotation. The symbol "b" designates a recess formed to prevent eccentric rotation of the driving flange 3*d*. An annular protrusion 7 formed on the outer periphery of the driving flange 3*d* prevents the flange 3*d* from separating.

Figure 9:
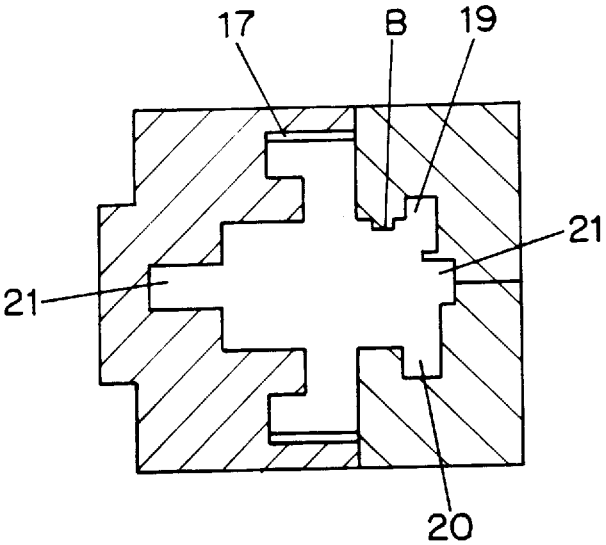
FIG. 9 is a cross section of a molding die for molding the driving flange of FIG. 4.

For molding the driving flange 3*d* of FIG. 4, the molding die of FIG. 9 has a gear molding portion 17, a conductor setting portion 19, an annular protrusion molding portion 20, a shaft insertion portion 21, and a protrusion "B" for forming the recess "b" on the flange 3*d*.

Figure 10:
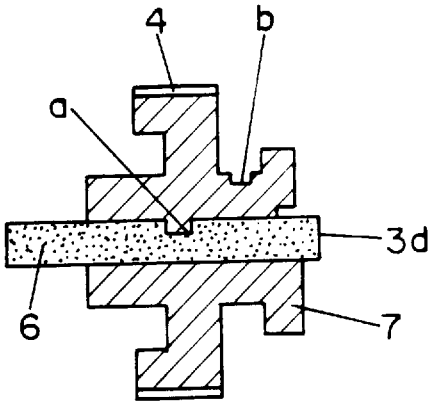
FIG. 10 is a cross section of the driving flange molded with the molding die of FIG. 9.

The flange 3*d*, whose structure is shown in FIG. 10, is formed by a first molding step in the molding die of FIG. 9 by setting the shaft 6 on which the recess "a" is formed, and loading and curing a mixture of a material having low sliding friction, e.g., a polyamide resin and carbon fiber. The fourth substrate 1*d*, of FIG. 4, is obtained by molding in a second molding step the cylindrical tube 2*d*, using a similar material as in the first embodiment, so that the unit including the flange 3*d*, shaft 6 and conductor 8 is further integrated unitarily with the cylindrical tube 2*d* such that the flange 3*d* is disposed at an end of the cylindrical tube 2*d*.

The resulting fourth substrate can be grounded easily and securely through the conductor 8 and the shaft 6. The annular protrusion 7 prevents the flange from separating from the cylindrical tube. The recess "b" prevents the flange and the cylindrical tube from eccentric rotation. The recess "a" securely fixes the shaft with the flange so that the shaft cannot separate from the flange and so that eccentric rotation is prevented.

In the embodiments described above, the recesses "a" and "b" may be replaced by protrusions. It suffices to form one recess or one protrusion for each of the recesses "a" and "b". Many shapes are suitable for the recess or protrusion, including a square, cylindrical or triangular column and the like.

The rotation axis of the cylindrical tube coincides with sufficient precision with the rotation axes of the driving flange and the shaft. In the second embodiment, where the cylindrical tube, driving flange and shaft are integrated as a unit, these are aligned essentially coaxially as their alignment is determined by the alignment of the constituent portions of the molding die. The measured coaxial alignment is from 10 to 30 $\mu$m for the substrate. Its cylindrical tube and flange, to which the shaft is insert-molded, are double molded. The coaxial alignment is from 10 to 30 $\mu$m for the substrate in which the cylindrical tube and the flange are double molded, and the shaft is not insert-molded with the flange but inserted into the through-hole of the flange. By comparison, the coaxial alignment is 30 to 60 $\mu$m for a conventional substrate in which the flange is inserted and bonded with adhesive to the cylindrical tube, and the shaft is inserted into the through-hole of the flange.

By coaxially aligning a driving flange, having a gear for transmitting the rotational driving force from the primary apparatus and having a shaft through-hole for supporting a metallic shaft, at an end of a cylindrical tube, and by unitarily molding the cylindrical tube and driving flange, both made mainly of an electrically conductive resin, a substrate is obtained which holds the cylindrical tube and the driving flange highly coaxially and which does not require a separate conductor for electrically interconnecting the cylindrical tube and shaft with the driving flange.

By unitarily molding the cylindrical tube and driving flange together with the shaft, smooth rotation of the substrate is facilitated, as the cylindrical tube, driving flange and shaft are disposed highly coaxially with one another. Without sliding portions, in a substrate made by unitary molding of the cylindrical tube and driving flange together with the shaft, the life of the substrate is prolonged. In this structure, by forming at least one recess or protrusion in the contact area of the shaft and flange, the shaft is prevented from separating from the flange, and eccentric rotation is prevented.

The gear may be formed on the outer or inner surface of the driving flange. By unitarily forming, by two-step molding, a cylindrical tube made mainly of an electrically conductive resin, a driving flange made of a material having low sliding friction and coaxially disposed at an end of the cylindrical tube and having a shaft through-hole for supporting a metallic shaft and a gear for transmitting the rotational driving force from the primary apparatus, and an electric conductor, the wear of the gear and sliding portions is greatly reduced. By forming at least one recess or protrusion in the contact area of the outer periphery of the driving flange and the cylindrical tube of the double-molded substrate, the driving flange is prevented from separating from the cylindrical tube and eccentric rotation is prevented. By mounting the shaft on the driving flange by insert molding in a first molding step and by integrating the flange and the cylindrical tube in a second molding step, the shaft is aligned highly coaxially with the substrate. By forming at least one recess or protrusion in the contact area of the insert-molded shaft and flange, the shaft is prevented from separating from the flange and eccentric rotation is prevented.

By using polyphenylene sulfide or polyphthalamide as the resin to which carbon black is added for conductivity, a substrate is provided with excellent heat resistance and chemical resistance.

What is claimed is:

1. A substrate for an electrophotographic photoconductor, comprising:

a cylindrical tube composed of an electrically conductive resin;

a metallic shaft;

a driving flange for rotating said substrate, pre-molded from a material having a coefficient of sliding friction of 0.3 or less and having a gear for transmitting rotational driving force and a through-hole for supporting said shaft coaxially with said cylindrical tube; and an electric conductor electrically interconnecting said cylindrical tube and said shaft;

said cylindrical tube, said driving flange and said electric conductor being integrally molded as a unit such that said driving flange is coaxially disposed at an end of said cylindrical tube.

2. The substrate of claim 1, further comprising at least one recess or protrusion in a contact area between said driving flange and said cylindrical tube.

3. A substrate for an electrophotographic photoconductor, comprising:

a cylindrical tube composed of an electrically conductive resin;

a metallic shaft;

a driving flange for rotating said substrate, pre-molded from a material having a coefficient of sliding friction of 0.3 or less and having a gear for transmitting rotational driving force, with said metallic shaft inserted into said driving flange in said pre-molding; and an electric conductor electrically interconnecting said cylindrical tube and said shaft;

said cylindrical tube, said driving flange and said electric conductor being integrally molded as a unit such that said driving flange is coaxially disposed on an end of said cylindrical tube and said metallic shaft is disposed coaxially with said cylindrical tube.

4. The substrate of claim 3, further comprising at least one recess or protrusion in a contact area between said metallic shaft and said driving flange, and at least one recess or protrusion in a contact area between said driving flange and said cylindrical tube.

5. The substrate of claim 1, wherein said electrically conductive resin comprises polyphenylene sulfide and carbon black.

6. The substrate of claim 3, wherein said electrically conductive resin comprises polyphenylene sulfide and carbon black.

7. The substrate of claim 1, wherein said electrically conductive resin comprises polyphthalamide and carbon black.

8. The substrate of claim 3, wherein said electrically conductive resin comprises polyphthalamide and carbon black.

* * * * *